US010096890B2

(12) United States Patent
Wu

(10) Patent No.: US 10,096,890 B2
(45) Date of Patent: Oct. 9, 2018

(54) ANTENNA MODULE

(71) Applicant: Jing Wu, Shenzhen (CN)

(72) Inventor: Jing Wu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/417,118

(22) Filed: Jan. 26, 2017

(65) Prior Publication Data

US 2017/0346161 A1 Nov. 30, 2017

(30) Foreign Application Priority Data

May 27, 2016 (CN) ..... 2016 2 0498534 U

(51) Int. Cl.

| | |
|---|---|
| ***H01Q 1/24*** | (2006.01) |
| ***H01Q 1/50*** | (2006.01) |
| ***H01Q 1/48*** | (2006.01) |
| ***H01Q 21/28*** | (2006.01) |
| ***H01Q 5/328*** | (2015.01) |

(52) U.S. Cl.

CPC ..... *H01Q 1/243* (2013.01); *H01Q 1/24* (2013.01); *H01Q 1/241* (2013.01); *H01Q 1/48* (2013.01); *H01Q 1/50* (2013.01); *H01Q 5/328* (2015.01); *H01Q 21/28* (2013.01)

(58) Field of Classification Search

CPC ..... H01Q 1/24; H01Q 1/241; H01Q 1/242; H01Q 1/243; H01Q 1/48; H01Q 1/50; H01Q 5/328; H01Q 21/28

See application file for complete search history.

(56) References Cited

U.S. PATENT DOCUMENTS

2004/0160370 A1* 8/2004 Ghosh ..... G06F 1/1616 343/702
2014/0218244 A1* 8/2014 Chang ..... H01Q 13/10 343/702

FOREIGN PATENT DOCUMENTS

CN 104103888 * 10/2014 ..... H01Q 1/24

* cited by examiner

*Primary Examiner* — Hoang Nguyen
(74) *Attorney, Agent, or Firm* — IPro, PLLC; Na Xu

(57) ABSTRACT

The present disclosure provides an antenna module, including a metal housing having accommodating space and a circuit board accommodated in the accommodating space, the metal housing includes a metal back cover and a metal side wall, the metal side wall includes a side wall main body and a first radiator extending from an end of the side wall main body, a second radiator extending from another end of the side wall main body which is spaced with and arranged opposite to the first radiator, and a third radiator provided between the first radiator and the second radiator, a headroom region is formed between the third radiator and the circuit board. The present disclosure provides an antenna module having frequency bands of wireless signal and a good overall appearance.

9 Claims, 3 Drawing Sheets

ANTENNA MODULE

TECHNICAL FIELD

The present disclosure relates to the field of mobile communications and, in particular, to an antenna module of a mobile terminal device.

BACKGROUND

With the development of wireless communication technologies, mobile terminals such as cellphone, tablet PC, portable multi-media player and the like are widely applied in people's life. A mobile terminal device is usually configured with an antenna module in the interior for transmitting and receiving wireless signals, so as to support wireless communication function of the mobile terminal device.

In order to improve integral strength of the product, current smart phones adopt metal housing more and more, such as metal back cover or metal frame. However, the metal housing will shield or absorb electromagnetic waves, resulting in problems such as narrow frequency band and low efficiency. With the development of mobile communication techniques, there are more and more modes that need the mobile terminal device to cover, including GSM/DCS/PCS/WCDMA/TD-SCDMA/LTE etc., different mobile communication modes adopt different frequency bands.

In the related art, the mobile terminal device needs to divide the metal housing into sections or using a special design so that the antenna will not be surrounded by the metal housing. However, such manner, in an aspect, will limit the radiation space of the antenna, thereby restricting frequency band of the antenna and, in another aspect, will affect the overall appearance of the mobile terminal device.

Therefore, there is a necessity to provide a new antenna module so as to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
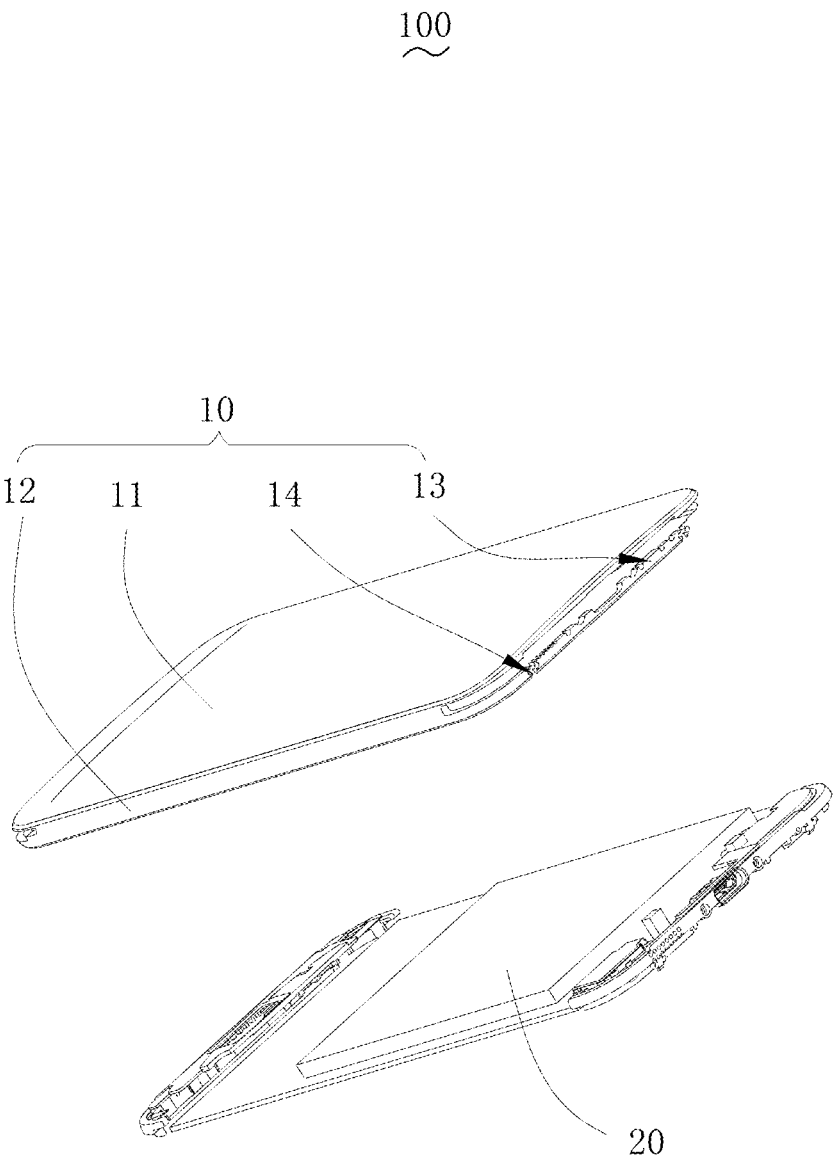
FIG. 1 is a perspective structural exploded view of an antenna module in accordance with the present disclosure.
Figure 2:
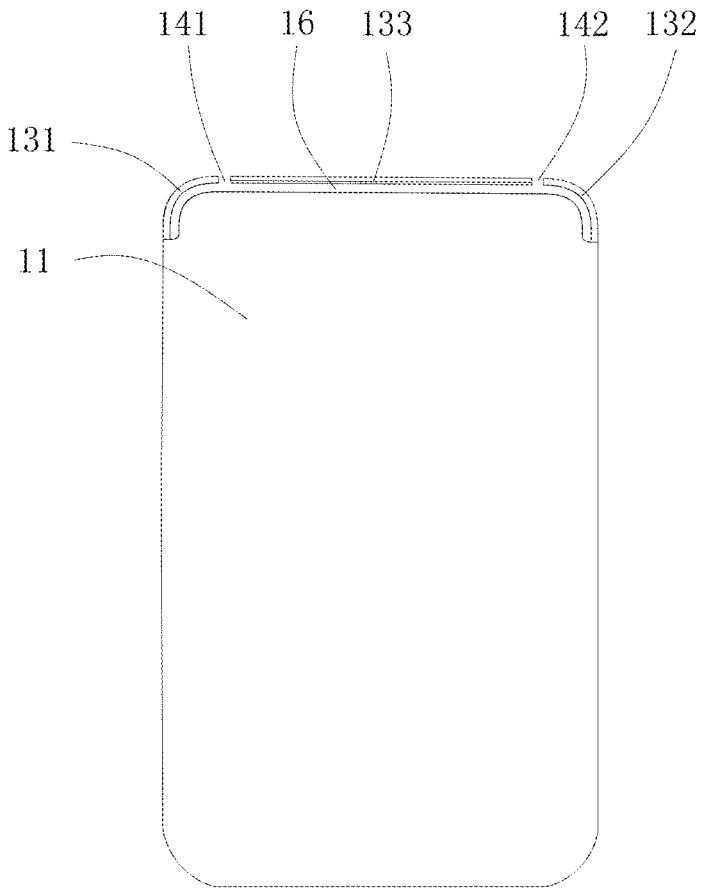
FIG. 2 is a combined structural view of the antenna module shown in FIG. 1.
Figure 3:
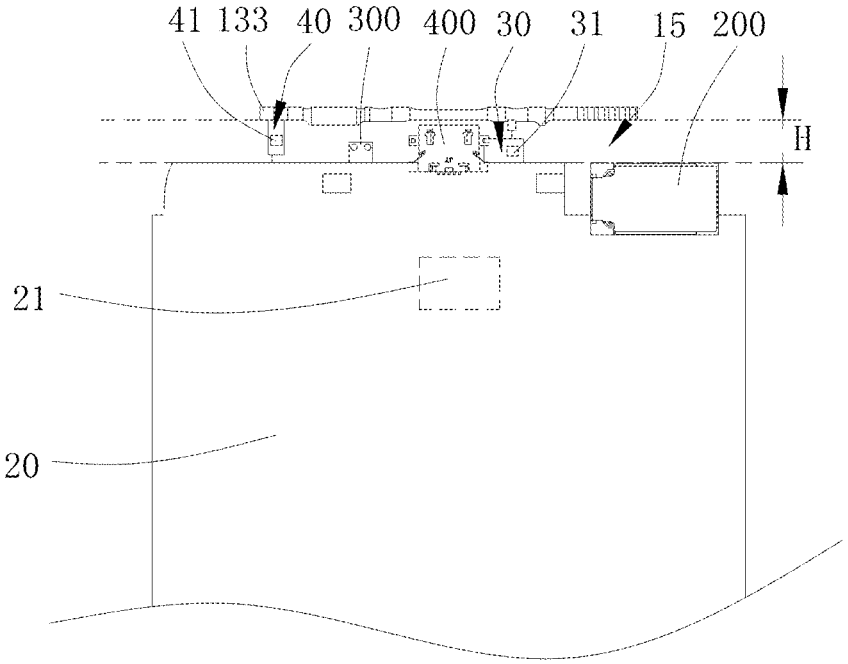
FIG. 3 is a structural schematic view of a third radiator and a circuit board shown in FIG. 1.

Please refer to FIG. 1, FIG. 2 and FIG. 3, FIG. 1 is a perspective structural exploded view of an antenna module in accordance with the present disclosure;

FIG. 2 is a combined structural view of the antenna module shown in FIG. 1; FIG. 3 is a structural schematic view of a third radiator and a circuit board shown in FIG. 1. The antenna module 100 includes a metal housing 10 having accommodating space, and a circuit board 20 accommodated in the accommodating space.

The metal housing 10 includes a metal back cover 11 and a metal side wall. The metal side wall includes a side wall main body 12 extending along an edge of the metal back cover 11, a radiator 13 extending from the side wall main body 12, and a fracture 14. The metal back cover 11 is used as an auxiliary radiator, which cooperates with the radiator 13. Specifically, the metal side wall extends along a direction perpendicular to the metal back cover 11. In the present embodiment, in order to enhance the signal radiation intensity, a plurality of connection points for electrically connecting with the circuit board 20 are provided at a side of the auxiliary radiator adjacent to the circuit board 20, so as to optimize the communication performance of the antenna module 100.

The radiator 13 includes a first radiator 131 extending from an end of the side wall main body 12, a second radiator 132 extending from another end of the side wall main body 12 which is spaced with and arranged opposite to the first radiator 131, and a third radiator 133 provided between the first radiator 131 and the second radiator 132. The first radiator 131, the second radiator 132 and the third radiator 133 are spaced with the metal back cover 11. A headroom region 15 is formed between the third radiator 131 and the circuit board 20. The headroom region 15 is provided with a speaker 200, a microphone 300 and a USB interface 400 in the interior. Specifically, a width H of the headroom region 15 is 7 mm.

The fracture 14 includes a first fracture 141 and a second fracture 142. The third radiator 133 forms the first fracture 141 and the second fracture 142 respectively with the first radiator 131 and the second radiator 132. The first fracture 141 and the second fracture 142 are respectively provided between the first radiator 131 and the third radiator 133, and between the second radiator 132 and the third radiator 133.

The radiator 13 and the metal back cover 11 are spaced so as to form a coupling gap 16. The coupling gap 16 is used for achieving frequency coupling of the antenna module 100. In the present embodiment, the coupling gap 16 can be provided at a joint position of the metal back cover 11, the metal side wall, the metal back cover 11 and the metal side wall.

The third radiator 133 extends towards the circuit board 20 so as to respectively form a grounding circuit 30 and a feeding circuit 40 which are electrically connected with the circuit board 20.

An end of the grounding circuit 30 is electrically connected with a system ground unit of the circuit board 20, the other end thereof is electrically connected with the third radiator 133. The grounding circuit 30 includes a radio frequency switch 31, the radio frequency switch 31 is connected in the grounding circuit 30 in series. The circuit board 20 includes a ground matching circuit 21 electrically connected with the grounding circuit 30, the ground matching circuit 21 includes a plurality of different connection circuits, each corresponds to a different capacitance or inductance.

When the coupling gap 16 is provided on the metal side wall, the radio frequency switch 31 includes a first position, a second position, a third position and a fourth position, when the radio frequency switch 41 is turned to the first position, a capacitance with a capacitance value of 0 pF is connected; when the radio frequency switch 31 is turned to the second position, a capacitance with a capacitance value of 0.3 pF is connected; when the radio frequency switch 31 is turned to the third position, a capacitance with a capacitance value of 0.8 pF is connected; in these three cases, the difference in the antenna module 100 is not much, however, there is significant difference in low frequency bandand high frequency band, thus the position of the radio frequency switch 31 can be selected according to actual needs. When the radio frequency switch 31 is turned to the fourth position, an inductance with an inductance value of 3 nH is connected, in such case, the antenna module 100 is stable and efficient in middle-low frequency band, but the difference in middle-high frequency band is large compared with the above three cases, thus the four positions can be selected according to actual needs.

When the coupling gap 16 is provided on the metal back cover 11, the radio frequency switch includes a first position, a second position, a third position and a fourth position, when the radio frequency switch is turned to the first position, a capacitance with a capacitance value of 0 pF is connected in the grounding circuit; when the radio frequency switch is turned to the second position, a capacitance with a capacitance value of 0.4 pF is connected in the grounding circuit; when the radio frequency switch is turned to the third position, a capacitance with a capacitance value of 1.2 pF is connected in the grounding circuit; in these three cases, the difference in the antenna module 100 is not much, however, there is significant difference in low frequency bandand high frequency band, thus the position of the radio frequency switch 31 can be selected according to actual needs. When the radio frequency switch is turned to the fourth position, an inductance with an inductance value of 1.5 nH is connected in the grounding circuit, in such case, the antenna module 100 is stable and efficient in middle-low frequency band, but the difference in middle-high frequency band is large compared with the above three cases, thus the four positions can be selected according to actual needs.

When the coupling gap 16 is provided at the joint position of the metal back cover and the metal side wall, the radio frequency switch includes a first position, a second position, a third position and a fourth position, when the radio frequency switch is turned to the first position, a capacitance with a capacitance value of 0 pF is connected in the grounding circuit; when the radio frequency switch is turned to the second position, a capacitance with a capacitance value of 0.4 pF is connected in the grounding circuit; when the radio frequency switch is turned to the third position, a capacitance with a capacitance value of 0.9 pF is connected in the grounding circuit; in these three cases, the difference in the antenna module 100 is not much, however, there is significant difference in low frequency band and high frequency band, thus the position of the radio frequency switch 31 can be selected according to actual needs. When the radio frequency switch is turned to the fourth position, an inductance with an inductance value of 2.5 nH is connected in the grounding circuit, in such case, the antenna module 100 is stable and efficient in middle-low frequency band, but the difference in middle-high frequency band is large compared with the above three cases, thus the four positions can be selected according to actual needs.

When the antenna module 100 is within 703-960 MHz, a resonance branch of the antenna module 100 is the third radiator 133; when the antenna module 100 is within 1710-2170 MHz and 2300-2690 MHz, a resonance branch of the antenna module 100 is the first radiator 131 and the second radiator 132.

An end of the feeding circuit 40 is electrically connected with a feeding end (not shown) of the circuit board 20, the other end thereof is electrically connected with the third radiator 133. The feeding circuit 40 includes a dynamic adjustable matching switch 41, the dynamic adjustable matching switch 41 is connected in the feeding circuit 40 in series. The dynamic adjustable matching switch 41 is an adjustable capacitance, through adjusting the adjustable capacitance, the feeding extent of the feeding circuit 40 can be adjusted.

The beneficial effect of the present disclosure is: when the antenna module 100 provided by the present disclosure is applied to relevant products, the radiator 13 can be the side wall of the product, through the coupling gap 16 formed by the radiator 13 and the metal back cover 11, there is no need to provide an individual coupling gap on the metal back cover 11 to as to be served as an auxiliary radiator, thereby guaranteeing integrality of the metal back cover 11, and improving appearance of the relevant product; moreover, through adjusting the frequency band by the radio frequency switch 31 and the adjustable capacitance 41 at the same time, the antenna module can have the function of multi-band adjusting, so that the product can have wider frequency band and better performance.

It should be noted that, the above are merely embodiments of the present disclosure, those skilled in the art can make improvements without departing from the inventive concept of the present disclosure, however, these improvements shall belong to the protection scope of the present disclosure.

What is claimed is:

1. An antenna module, comprising: a metal housing having accommodating space; and a circuit board accommodated in the accommodating space, wherein the metal housing comprises a metal back cover and a metal side wall, the metal side wall comprises a side wall main body and a first radiator extending from an end of the side wall main body, a second radiator extending from another end of the side wall main body which is spaced with and arranged opposite to the first radiator, and a third radiator provided between the first radiator and the second radiator, the third radiator forms a first fracture and a second fracture respectively with the first radiator and the second radiator, the first radiator, the second radiator and the third radiator are respectively spaced with the metal back cover to form a coupling gap, a headroom region is formed between the third radiator and the circuit board, a grounding circuit and a feeding circuit are extended from the third radiator and are electrically connected with the circuit board, respectively; and wherein the coupling gap is provided on the metal side wall, the radio frequency switch comprises a first position, a second position, a third position and a fourth position, when the radio frequency switch is turned to the first position, a capacitance with a capacitance value of 0 pF is connected in the grounding circuit, when the radio frequency switch is turned to the second position, a capacitance with a capacitance value of 0.3 pF is connected in the grounding circuit when the radio frequency switch is turned to the third position, a capacitance with a capacitance value of 0.8 pF is connected in the grounding circuit when the radio frequency switch is turned to the fourth position, an inductance with an inductance value of 3 nH is connected in the grounding circuit.

2. The antenna module as described in claim 1, wherein the third radiator is a low frequency resonance branch of the antenna module, the first radiator and the second radiator constitute a high frequency branch of the antenna module.

3. The antenna module as described in claim 1, wherein the metal side wall extends along a direction perpendicular to the metal back cover.

4. The antenna module as described in claim 1, wherein a width of the headroom region is 7 mm.

5. The antenna module as described in claim 1, wherein the grounding circuit comprises a radio frequency switch, the radio frequency switch is connected in the grounding circuit in series; the circuit board comprises a ground matching circuit electrically connected with the grounding circuit, the ground matching circuit comprises a capacitance or an inductance.

6. The antenna module as described in claim 5, wherein the coupling gap is provided on the metal back cover, the radio frequency switch comprises a first position, a second position, a third position and a fourth position, when the radio frequency switch is turned to the first position, a capacitance with a capacitance value of 0 pF is connected in the grounding circuit; when the radio frequency switch is turned to the second position, a capacitance with a capacitance value of 0.4 pF is connected in the grounding circuit; when the radio frequency switch is turned to the third position, a capacitance with a capacitance value of 1.2 pF is connected in the grounding circuit; when the radio frequency switch is turned to the fourth position, an inductance with an inductance value of 1.5 nH is connected in the grounding circuit.

7. The antenna module as described in claim 5, wherein the coupling gap is provided at a joint position of the metal back cover and the metal side wall, the radio frequency switch comprises a first position, a second position, a third position and a fourth position, when the radio frequency switch is turned to the first position, a capacitance with a capacitance value of 0 pF is connected in the grounding circuit; when the radio frequency switch is turned to the second position, a capacitance with a capacitance value of 0.4 pF is connected in the grounding circuit; when the radio frequency switch is turned to the third position, a capacitance with a capacitance value of 0.9 pF is connected in the grounding circuit; when the radio frequency switch is turned to the fourth position, an inductance with an inductance value of 2.5 nH is connected in the grounding circuit.

8. The antenna module as described in claim 1, wherein the feeding circuit comprises a dynamic adjustable matching switch, the dynamic adjustable matching switch is connected in the feeding circuit in series.

9. The antenna module as described in claim 8, wherein the dynamic adjustable matching switch is an adjustable capacitance.

* * * * *